United States Patent [19]

Marquis

[11] Patent Number: 4,962,553

[45] Date of Patent: Oct. 16, 1990

[54] INFLATABLE MATTRESS STRUCTURE

[76] Inventor: Charles E. Marquis, #228 3400 Chateau Blvd., Kenner, La. 70065

[21] Appl. No.: 340,203

[22] Filed: Apr. 19, 1989

[51] Int. Cl.[5] ..... A47C 27/10

[52] U.S. Cl. ..... 5/455; 5/61; 5/465

[58] Field of Search ..... 5/61, 455, 465, 441, 5/449, 453, 454, 456

[56] References Cited

U.S. PATENT DOCUMENTS

| | | | |
|---|---|---|---|
| 1,772,310 | 8/1930 | Hart | 5/61 |
| 2,731,652 | 1/1956 | Bishop | 5/455 |
| 3,274,624 | 9/1966 | Noerdinger | 5/455 |
| 3,428,974 | 2/1969 | Stuart | 5/455 |
| 3,477,071 | 11/1969 | Emerson | 5/61 |
| 3,485,240 | 12/1969 | Fountain | 5/61 |
| 3,492,988 | 2/1970 | De Mare | 5/61 |
| 3,775,781 | 12/1973 | Bruno et al. | 5/61 |
| 4,459,714 | 7/1984 | Lin | 5/465 X |
| 4,629,433 | 12/1986 | Magio | 5/449 X |
| 4,631,765 | 12/1986 | Casey | 5/465 X |
| 4,638,519 | 1/1987 | Hess | 5/453 X |
| 4,697,290 | 10/1987 | Alkind et al. | 5/61 |
| 4,745,647 | 5/1988 | Goodwin | 5/453 |

FOREIGN PATENT DOCUMENTS

| | | | |
|---|---|---|---|
| 2816642 | 10/1978 | Fed. Rep. of Germany | 5/61 |
| 2800727 | 7/1979 | Fed. Rep. of Germany | 5/61 |
| 946831 | 1/1964 | United Kingdom | 5/61 |

*Primary Examiner*—Eric K. Nicholson

*Attorney, Agent, or Firm*—Fleit, Jacobson, Cohn, Price, Holman & Stern

[57] ABSTRACT

An inflatable mattress structure for an invalid's bed has separately inflatable transverse sections which can be releasably secured together to form the mattress. Additionally, each section is itself divided lengthwise into separately inflatable left- and right-hand portions. Thus, in the structure as a whole, the left and right sides of the mattress can be selectively inflated and deflated to position an occupant on one or other side.

1 Claim, 1 Drawing Sheet

INFLATABLE MATTRESS STRUCTURE

BACKGROUND OF THE INVENTION

This invention relates to inflatable mattress structures, more particularly for use on invalid or hospital beds.

Inflatable air cushion and mattress type structures are quite well known and exist in various forms. One type of inflatable air cushion structure is manufactured by Roho Incorporated of 100 Florida Avenue, Belleville, Illinois 62221 and comprises rows of inflatable upstanding cells or bulbs on a common flattish manifold type base which has a single inflation valve for inflating the cells or bulbs in unison through the manifold. The device is useful, for example, for therapeutic purposes as a chair cushion and the like because, inter alia, selected bulbs can be closed off by constricting the bulb to obtain variations in cushion resistance and the like. The Roho cushions exist in both high-profile and low-profile models having different bulb heights.

It is also known to form a mattress structure from cushions of the kind described above by connecting together transverse mattress sections, each of which is formed by one of the cushion structures so that a mattress is effectively provided to a specified length by connecting together the required number of mattress sections lengthwise of the structure. Typically, a mattress structure of this nature may have four transverse sections connected together by Velcro fasteners or the like, each section, for example, having 10 bulbs or cells extending lengthwise of the mattress and 18 bulbs or cells extending widthwise of the mattress.

Examples of inflatable structures as discussed above may be found in prior U.S. Pat. Nos. 3,605,145; 3,870,450; 4,005,236 and in Canadian Pat. No. 1,044,823.

SUMMARY OF THE INVENTION

While inflatable air cushion type mattress structures as described above offer a certain facility for adjusting the mattress pressure lengthwise of a patient for therapeutic purposes, they provide no means for pressure control or adjustment which enables an immobile patient to be positioned on one or other side. The present invention provides a mattress structure which incorporates this provision.

Thus, in accordance with the invention, an inflatable mattress structure which may be generally of the kind described above is divided lengthwise of the structure into separate inflatable portions. Accordingly, with a patient on the mattress, the left-hand portion may be deflated and the right-hand portion inflated to position a patient on his or her left side and vice versa.

Preferably, the inventive mattress structure may, again, be sectionalized transversely as in the known structure and each transverse section may itself be divided longitudinally into left and right separately inflatable portions. Again, the separate sections may be selectively and releasably secured together to form the structure and each section itself may be formed from separate inflatable cushions permanently secured together side by-side. Conveniently, each separate cushion may be a bulb type cushion as previously described with nine bulbs extending transversely of the mattress structure and eight bulbs standing lengthwise of the structure. The separate cushions may be permanently secured together by adhesive to form a transverse mattress section.

Additional features and advantages of the invention will become apparent from the ensuing description and claims read in conjunction with the attached drawings

DESCRIPTION OF PREFERRED EMBODIMENT

Figure 2:
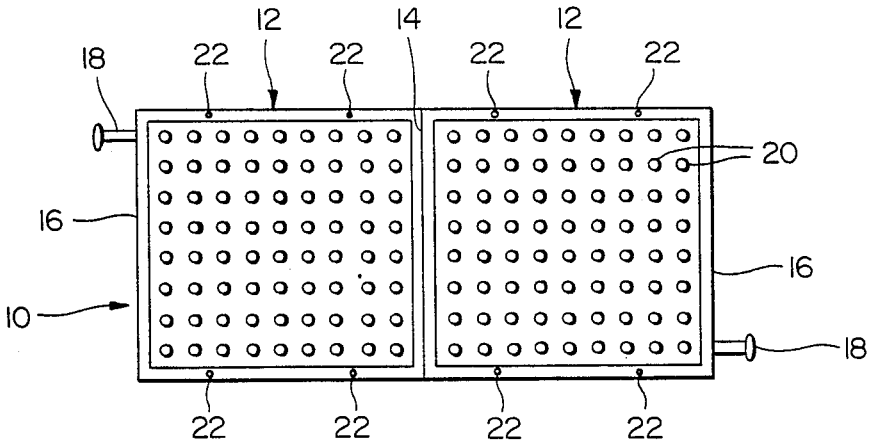
FIG. 2 is a somewhat diagrammatic plan view of one transverse section of the mattress structure.
Figure 3:
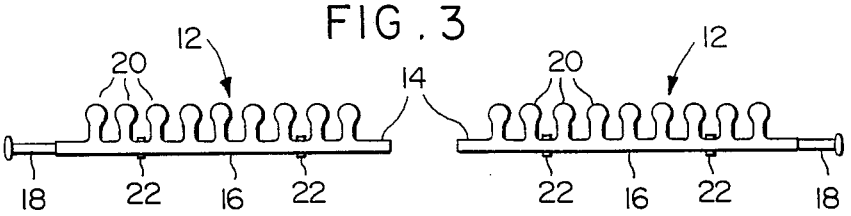
FIG. 3 is a somewhat diagrammatic elevational view of separate portions of the mattress section shown in FIG. 2 prior to the portions having been secured together.

Referring initially to FIGS. 2 and 3, there is shown therein an inflatable mattress section generally indicated by reference 10 which consists essentially of a pair of two like inflatable air cushions 12 suitably secured together, for example, by adhesive, along their inner margins 14. Each of the cushions 12 conveniently may comprise a Model No. 1R89 single valve highprofile therapeutic cushion manufactured by the aforementioned Roho Incorporated, such cushion having a substantially flat inflation manifold portion 16 with a smooth bottom as clearly shown in FIG. 3, an inflation valve 18 and a grid-like array of lengthwise and transverse intersecting rows of upstanding or upwardly extending inflation cells or bulbs 20. Thus, in each cushion, there are nine bulbs in each transverse row and eight bulbs in each lengthwise row.

Figure 1:
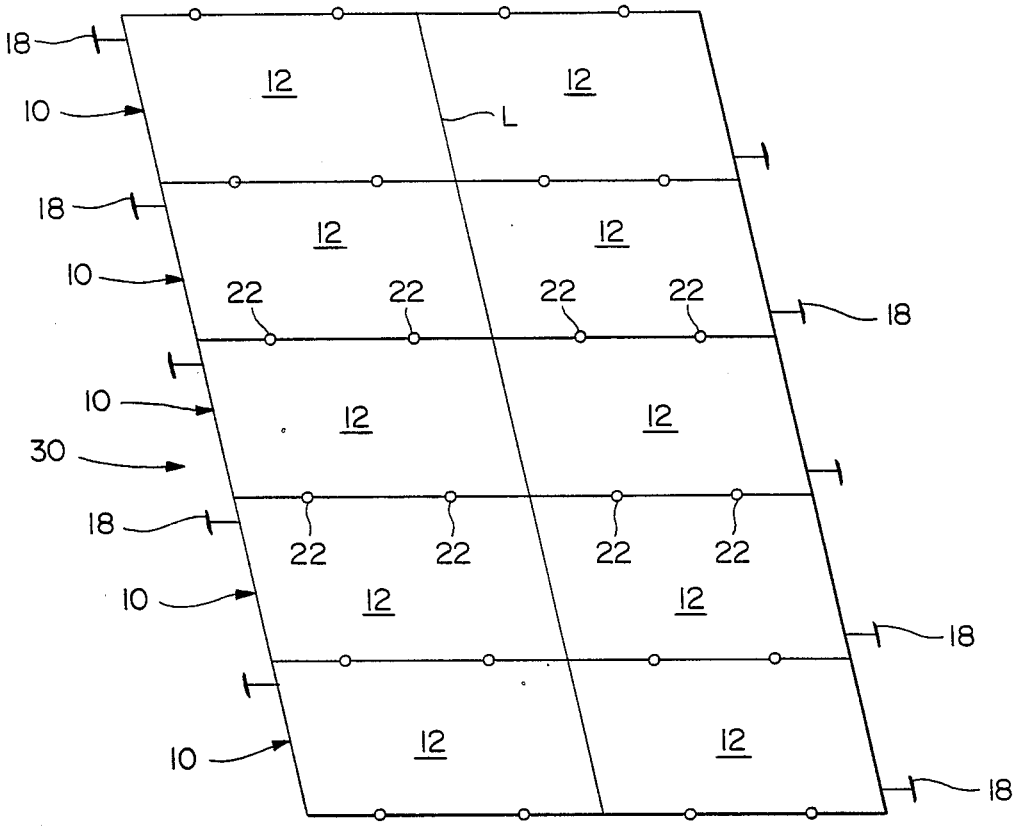
FIG. 1 is a diagrammatic view of an inflatable mattress structure in accordance with the invention.

As previously mentioned, the cushions 12 are secured together along their inner margins 14, for example, by an adhesive substance which is compatible for use with the flame resistant neoprene rubber from which the cushions are manufactured. Also, each mattress section 10 is provided along its transverse margins with similarly aligned snap fasteners 22 (or other suitable fastener means) whereby the respective cushion sections may be secured together lengthwise to form a mattress structure 30 as shown in FIG. 1 with each mattress section 10 extending widthwise of the mattress structure. Grommets (not shown) may be provided for holding the air adjustment valves 18 out of position when the entire mattress structure is in use.

It will be understood that the complete mattress structure 30 is extremely versatile in its use insofar as the inflation pressures can be adjusted and the mattress sections can be selectively attached and detached. Thus, for example, each individual cushion 12 can be separately inflated and deflated; individual sections 10 can be removed from the mattress as required; and, most importantly, all of the cushions 12 on one or other side of the longitudinal center line L of the mattress can be inflated or deflated selectively to place an occupant of the mattress on the occupant's one or other side. Additionally, a single mattress section 10 may, for example, be removed, e.g., when a bed pan is required.

While only a preferred embodiment of the invention has been disclosed herein in detail, the invention is not limited thereby and modifications can be made within the scope of the attached claims. For example, while the mattress structure has been described as using a particular form of air cushion structure, this particular form of structure is not critical to the invention as defined in the claims.

I claim:

1. An inflatable mattress structure for use on an invalid bed or the like, the mattress structure having a length dimension and a width dimension, which comprises:

a plurality of pairs of separately inflatable air cushions defining respective pairs of separately inflatable air cushion mattress portions, each of the air cushions including an essentially flat manifold having a smooth bottom, a separate inflation valve and a grid-like array of intersecting rows of separate, simultaneously inflatable bulbs extending upwardly from the manifold, with each intersecting row including a plurality of the separate, simultaneously inflatable bulbs;

each singular cushion of the pair of cushions which makes up each pair of the separately inflatable air cushion mattress portions having an edge portion permanently bonded by an adhesive to an adjacent edge portion of the corresponding singular cushion which makes up the pair, the pair of air cushion mattress portions defining a removable and replaceable mattress section having a dimension which corresponds to and defines the width of the inflatable mattress structure; and cooperable snap-type fastener means on other transversely extending edge portions of each of the singular cushions of the pair of cushions which makes up each of the paris of inflatable air cushion mattress portions, for interconnecting the mattress sections defined by the pairs of air cushion mattress portions together to define the length of the mattress structure, the snap-type fastener means and the smooth bottoms of the air cushions combining to facilitate selective separation of at least one of the mattress sections from the remainder of the mattress structure, removal of the separated mattress section from beneath a patient on the mattress structure, subsequent replacement of the removed mattress section beneath the patient, and reconnection of the replaced mattress section to the remainder of the mattress structure, the pairs of air cushion mattress portions also essentially defining respective opposite halves of the mattress structure so that the patient on the mattress structure can be selectively positioned on one half or the other half of the mattress structure by selective inflation and deflation of the air cushion mattress portions.

* * * * *